US005667065A

United States Patent [19]

Fahrion

[11] Patent Number: 5,667,065

[45] Date of Patent: Sep. 16, 1997

[54] STACKABLE PACKAGING UNIT

[76] Inventor: Otmar Fahrion, Durerstrasse 9, D-70806, Kornwestheim, Germany

[21] Appl. No.: 454,355

[22] PCT Filed: Dec. 16, 1993

[86] PCT No.: PCT/EP93/03576

§ 371 Date: Aug. 3, 1995

§ 102(e) Date: Aug. 3, 1995

[87] PCT Pub. No.: WO94/14669

PCT Pub. Date: Jul. 7, 1994

[30] Foreign Application Priority Data

Dec. 19, 1992 [DE] Germany ..... 92 17 413.2 U

[51] Int. Cl.[6] ..... B65D 19/02; B65D 21/032

[52] U.S. Cl. ..... 206/599; 108/53.1; 108/53.3; 108/55.1; 206/511

[58] Field of Search ..... 108/53.1, 53.3, 108/53.5, 55.1; 206/386, 595–600, 509, 511

[56] References Cited

U.S. PATENT DOCUMENTS 4,480,748 11/1984 Wind .
4,550,830 11/1985 Shuert .
4,580,680 4/1986 Wind .
4,989,731 2/1991 Shuert .

FOREIGN PATENT DOCUMENTS 2 165 676 7/1973 Germany .
WO93/24380 12/1993 WIPO .

*Primary Examiner*—Jimmy G. Foster
*Attorney, Agent, or Firm*—Lowe, Price, LeBlanc & Becker

[57] ABSTRACT

A stackable packaging unit (10) has a lower supporting pallet (12), a marginal wall arrangement (14) made of corrugated cardboard and a covering pallet (16) having the same geometry as the supporting pallet. Both pallets are moulded parts with feet (28 to 32) and have receptions (34 to 38) for the feet on their upper surface. The feet and the feet receptions are asymmetrical, so that the feet of an upper pallet engage the underlying feet receptions (34 to 38) over a short distance (Z1) in a first relative position of two adjacent pallets (12, 16) but engage them over a longer distance in a second relative position. The pallets (12, 16) may thus be closely stacked after use of the packaging unit and transported back to their point of origin.

16 Claims, 6 Drawing Sheets

STACKABLE PACKAGING UNIT

FIELD OF THE INVENTION

The invention relates to a stackable packaging unit.

BACKGROUND OF THE RELATED ART

In known packaging units of this type, the pallets lying at the bottom end of the unit are pressboard moulded parts with a substantially uniform thickness over the plane of the pallet so that, on the upper side of the pallet, receptors are automatically obtained in the pallet feet into which the feet of another pallet may be introduced when the pallets are stacked after use for transportation back to the point of origin. The marginal wall arrangement is as a rule manufactured from corrugated cardboard and when seen in a top view has the shape of a rectangle. For transport back to the starting position after using the packaging unit, the marginal wall arrangement can be folded down flat. A lid placed on the marginal wall arrangement consists of a pressboard sheet. When stacking the packaging units the feet of another packaging unit are put down on this lid. The lids can likewise be stacked after use of the packaging units and be transported back to the point of origin.

SUMMARY OF THE INVENTION

The object of the present invention is to provide, a stackable packaging unit in which pallets, marginal wall arrangement and lid are still stackable while with a built-up packaging unit a positive positioning of a packaging unit on a packaging unit lying underneath it is obtained by simple means.

In a packaging unit according to the invention, a pallet is likewise used as a lid which has the same geometry as the pallet lower. In this manner the upper and lower end parts of the packaging unit may be stacked together indiscriminately and transported back to the point of origin. The storage and manufacturing costs for the elements of the packaging unit are reduced since, from the point of view of the marginal wall arrangement, only a single additional element is needed which on the one hand fulfils the function of the pallet and on the other hand the function of a positioning lid. Since the stackable pallets exhibit a high mechanical strength with low weight due to their design, a weight saving is obtained relative to previous lids which are simple sections of pressboard sheets.

With a further improvement of the invention secure positioning and fixing of the marginal wall arrangement is obtained at its lower and upper end, respectively.

With a further improvement of the invention a situation is reached that packaging units stacked on top of one another are separated by a distance such that the fork of a fork-lift truck may be rapidly moved between the feet of a packaging unit without the fork having to be aligned very precisely in a vertical direction. Despite this it can be guaranteed that, after dismantling the packaging unit, the pallets may be transported back tightly stacked for reuse.

According to a further improvement positions between successive pallets that are visually easily discernible and in which the feet of the upper pallet engage a variable distance into the foot receptors of the pallet lying below may be realised in a simple manner.

A still further improvement of the invention is advantageous in respect of simple recognition of the relative position of pallets lying on top of one another.

The invention is elucidated in more detail below by means of implementation examples with reference to the drawings. These show the following:

DETAILED DESCRIPTION OF THE PREFERRED EMBODIMENTS

Figure 1:
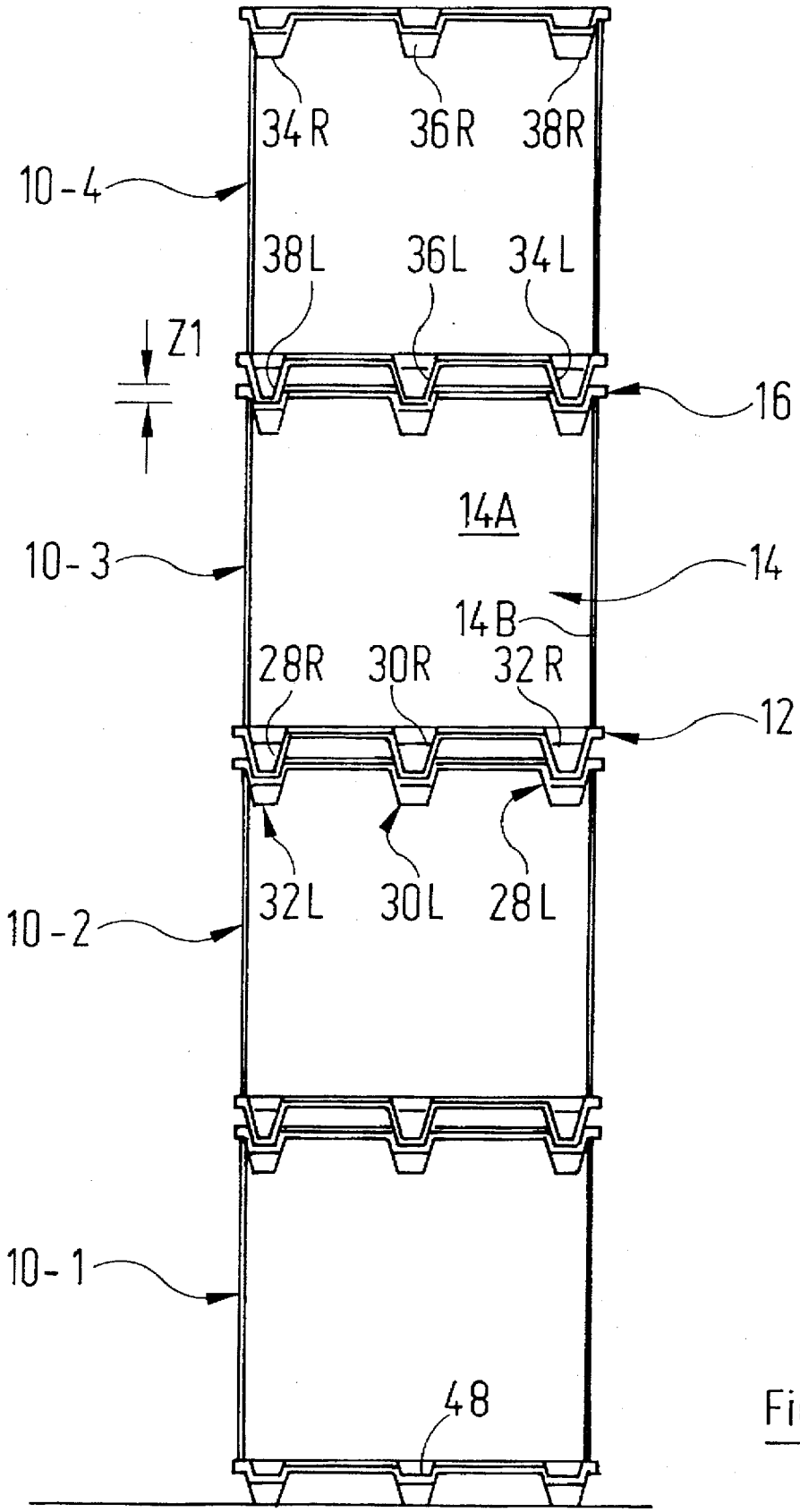
FIG. 1: a vertical section through a stack of packaging units.

In FIG. 1 four packaging units 10-1 to 10-4 which are stacked on top of one another are shown, each consisting of a support pallet 12, a marginal wall arrangement 14 made of corrugated cardboard and a cover pallet 16. The marginal wall arrangement 14 has vertical longitudinal walls 14A and vertical side walls 14B which are perpendicular to them in the unfolded state. The side walls 14A and 14B are jointed at the vertically abutting edges by fold lines.

Inside the packaging units 10-i (1-1, 2, 3, 4) are arranged products which are not shown here in detail e.g. refrigerators, cookers, washing machines etc.. The products are fixed to the support pallets 12 by first straps (not shown) which extend through corresponding rim cutouts in the marginal wall arrangement 14 or through openings 18 in the support pallets 12 as are shown in FIG. 3.

The support pallets 12 and cover pallets 16 are identical moulded parts made from compressed chip wood. As may be seen from FIG. 3, radial reinforcement ridges 20 running in the plane of the sheet together with reinforcement ridges 22 adjacent to the pallet rim ensure the high load-bearing capacity and torsional stiffness of the pallets with only small overall wall thickness.

Figure 3:
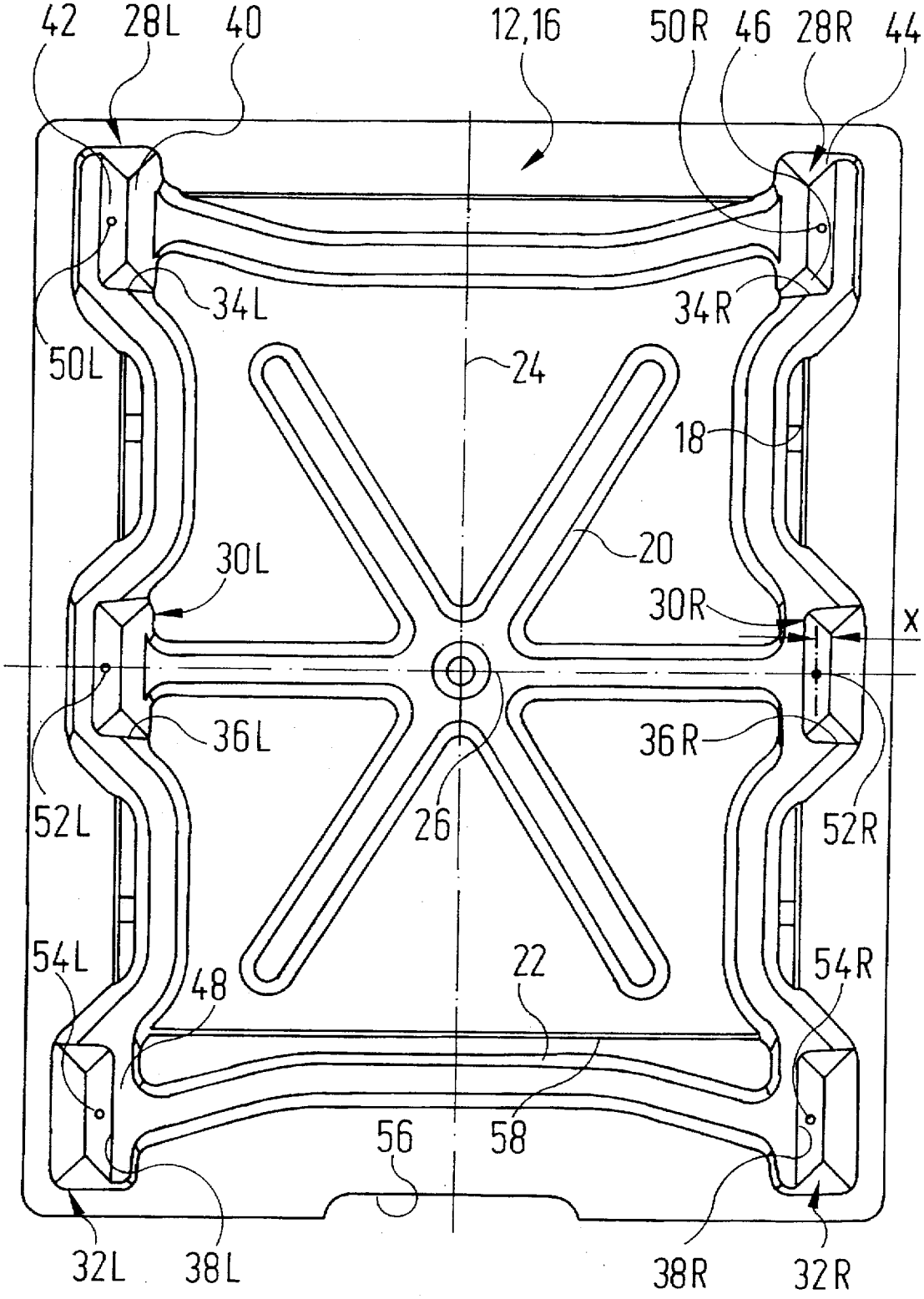
FIG. 3: a top view of the upper side of a pallet for a packaging unit according to FIG. 1 on an enlarged scale.

In FIG. 3, the longitudinal centre plane of a pallet is designated by 24 and the transverse centre plane by 26. Three feet 28L, 30L and 32L lying to the left of the longitudinal centre plane and three feet 28R, 30R and 32R lying to the right of the longitudinal centre plane 24 are formed onto the pallet. Their upper sides provide foot receptors 34L, 36L, 38L or 34R, 36R, 38R.

The feet 28 to 32 and with them also the foot receptors 34 to 38 have roughly the shape of a hipped roof exhibiting a step with principal surfaces 40, 42 and end surfaces 44, 46. As may be seen from FIG. 4, the inner lying main surfaces 40 each have a ledge 48.

The feet 38 to 32 and foot receptors 34 to 38 which are thus in themselves asymmetric are now again arranged in places in the pallet which are asymmetrical relative to the longitudinal centre plane 24 or to the central axis of the pallet standing perpendicular to the plane of the drawing in FIG. 3. In FIG. 3, points which designate symmetrical comparison positions for feet 28 to 32 or foot receptors 34 to 38 are indicated by 50L, 52L and 54L or 50R, 52R, 54R.

As may be seen from FIG. 3, the feet 28L and 28R are arranged so as to be displaced a distance X from the reference points 50L and 50R in an outward direction whilst the feet 32L and 32R are displaced inwards from the reference points 54L or 54R by the same distance X at the other end of the pallet. The centre foot 30L is displaced outwards from the comparison point 52L and the centre foot 30R displaced inwards from the comparison point 32R.

At one of the transverse edges, the pallets are provided with a rim recess 56 which serves as a marking. Instead of this or in addition, the corresponding pallet rim cutout can be marked with a layer of colour.

Figure 2:
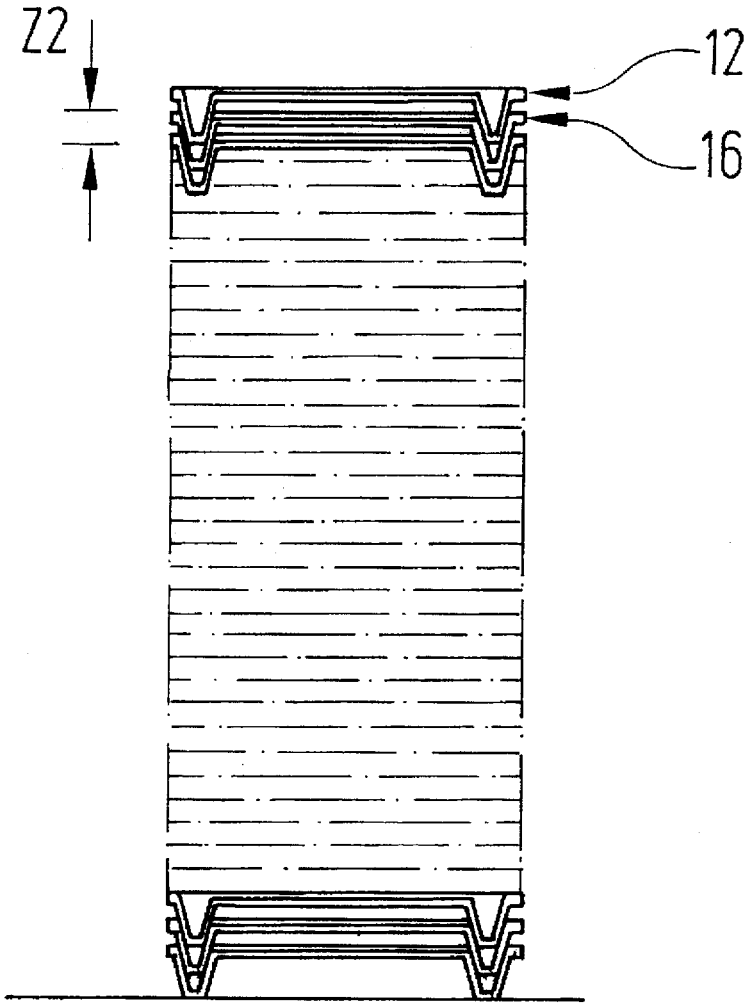
FIG. 2: a vertical section through a pallet stack made up of pallets which had formed the upper and lower end parts of the packaging units shown in FIG. 1 and further such packaging units.

If pallets with the geometry shown in FIG. 3 are stacked on top of one another such that their rim recesses 56 are in alignment, their feet and foot receptors are also aligned so that the pallets are stacked with a small gap. A corresponding stack of pallets is shown in FIG. 2 whereby Z2 designates the large engagement distance of the feet into the foot receptors lying below. The separation from successive pallets is correspondingly small.

Figure 4:
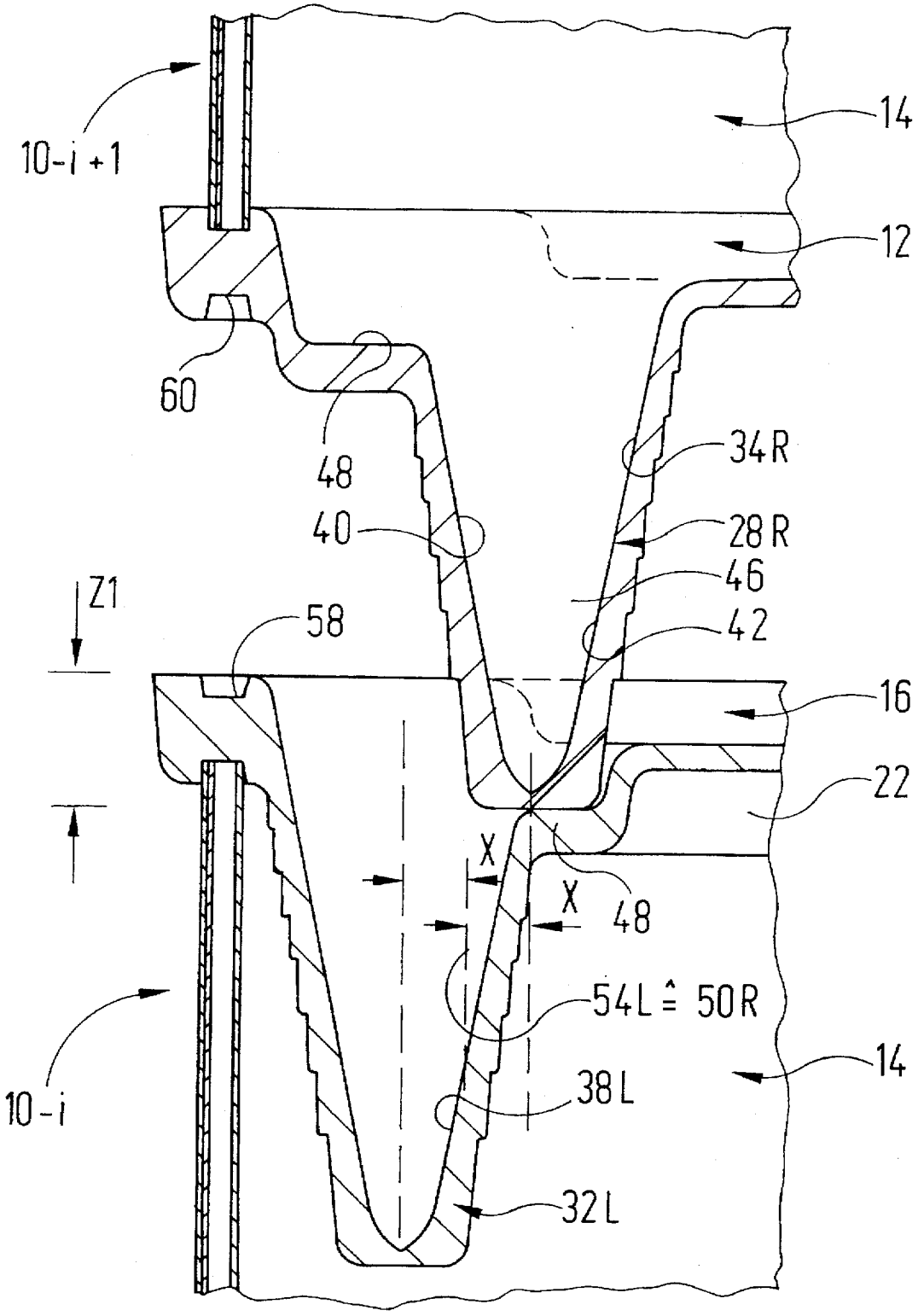
FIG. 4: a still further enlarged vertical section through the corner region of two of the units lying on top of one another in the stack shown in FIG. 1.

If, by contrast, the pallets are stacked on top of one another such that a lateral edge provided with a rim recess 56 aligns with a recess-free lateral edge (i.e. the upper pallet is rotated through 180° with respect to the lower pallet), the feet of the upper pallet stand directly on the ledges 48 of the pallet below. i.e. the relationship shown in FIG. 4 is obtained. This relationship is present between the support pallets 12 and cover pallets 16 of the packaging units 10 shown in FIG. 1. Z1 indicates the small engagement distance of the feet into the foot receptors lying below. Accordingly, a large separation is obtained between the cover pallets 16 and the support pallets 12 of the next packaging unit lying above them.

The taper of the feet and the material thickness of the pallets is preferably adapted such that there is a gap between successive pallets even with an aligned arrangement of the rim recesses 56 i.e. with identically aligned pallets in a stack, as is shown in FIG. 2, that still just enables introduction of the fork of a fork lift. In practice, this gap amounts to around 15 mm. In this manner, it is also possible with the application of special care to still separate with the fork lift truck, packaging units in which a cover pallet or a support pallet is inadvertently misaligned.

As may be seen from FIGS. 3 and 4, the upper sides of pallets 12 and 16 seen in top view have a groove 58 running round the pallet rim for acceptance of the lower ends of a marginal wall arrangement 14. The lower sides have a groove 60 aligned with this for acceptance of the upper ends of a marginal wall arrangement 14. The walls of the grooves 58, 60 are slightly inclined in order to facilitate the introduction of the corrugated cardboard material.

Figure 5:
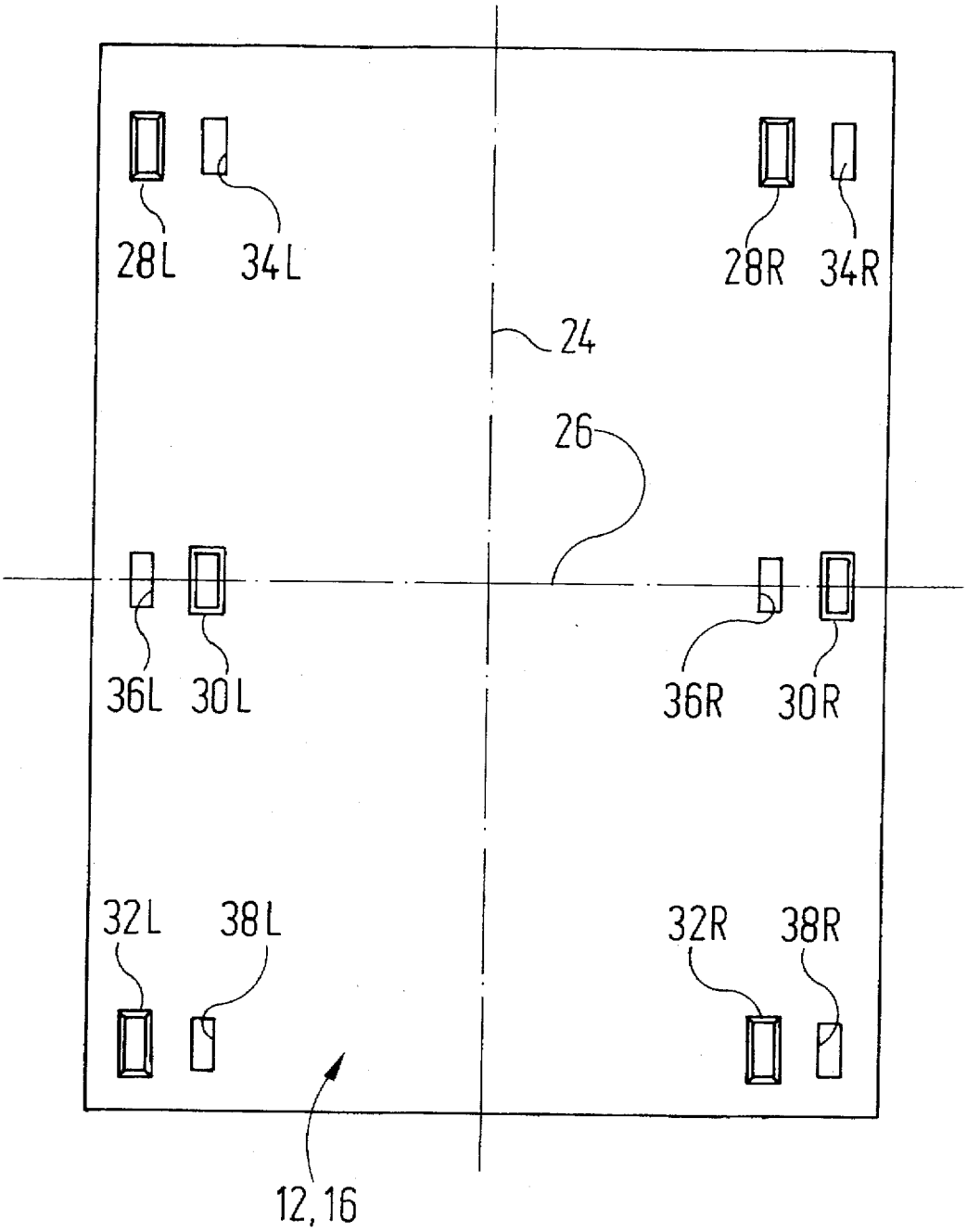
FIG. 5: a view similar to that of FIG. 3 in which a modified pallet is reproduced.

The implementation example schematically illustrated according to FIG. 5 differs from that according to FIGS. 3 and 4 in that the distance X is chosen to be of a size such that ledge 48 lies outside the feet 28 to 32 and forms the base of separate flat foot receptors 62L, 62R, 64L, 64R, 66L and 66R.

If the pallets according to FIG. 5 are folded together along the longitudinal centre plane 24, the pairs of foot receptors 62L, 62R etc. do not overlap and nor do the pairs of feet 28L, 28R etc. Overlapping is however obtained in each case between a foot and a foot receptor e.g. 28L and 62R.

Figure 6:
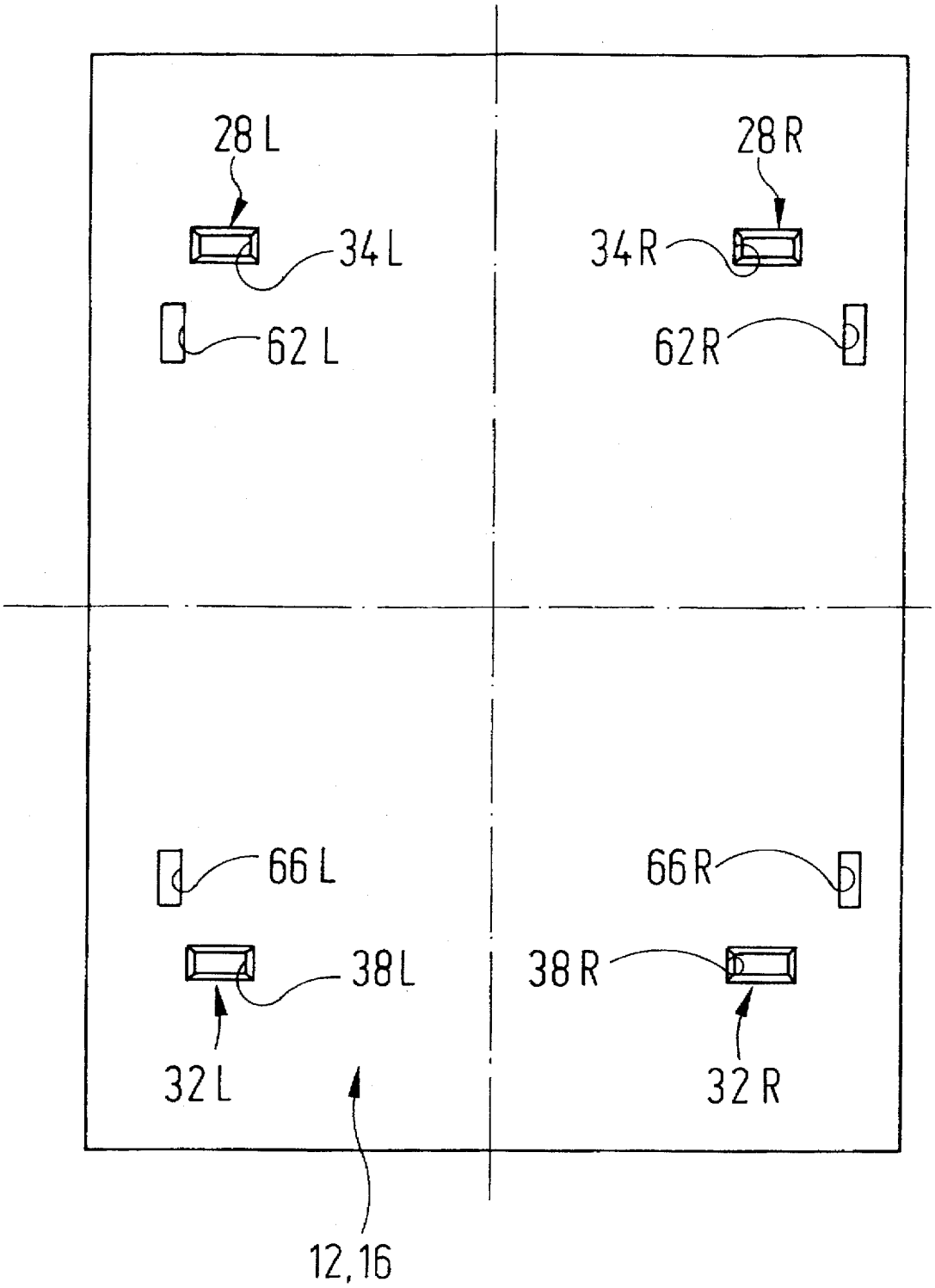
FIG. 6: a top view of a further modified pallet.

In the implementation example according to FIG. 6, four pallet feet 28L, 28R and 32L as well as 32R are provided displaced inwards somewhat from the corners. Their upper sides again form foot receptors 34L, 34R and 38L, 38R in which the feet of a pallet lying on top can find extensive acceptance so that the pallets can again be arranged into a stack as shown in FIG. 2.

In the upper side of the pallets there are again formed flat foot receptors 62L, 62R, 64L, 64R which can accept a lowest section of the feet 28 and 32 if the upper pallet is rotated by 90°. The foot receptors 52 and 64 are flat comparable to foot receptors 34 and 38. By using the pallets shown in FIG. 6, similar packaging units to those shown in FIG. 1 are assembled. For stacking the different packaging units on top of one another, they are however each rotated through 90° so that large gaps are again obtained between the packaging units into which the forks of a fork-lift truck may easily introduced.

It goes without saying that further flat foot receptors like foot receptors 62 and 64 can also be provided with a smaller angular separation and thus in larger numbers. The packaging units 10-i are then stacked on top of each other, displaced from one another by this smaller angle so that a helical stack is obtained.

From the above description of implementation examples, the following characteristics of the packaging unit according to the invention are evident:

The assembled packaging unit encompasses a large volume and can also accept heavy objects. Consisting of only two different elements (pallet, marginal wall arrangement), it is in itself easily stackable and compact for sending back for reuse.

Since the base part and lid part are identical, warehousing is simplified and due to the higher quantities a lower unit price is possible for this part.

The goods taken in are also particularly well protected against falling objects since the lid part is likewise a pallet and therefore exhibits a high mechanical strength.

The high mechanical strength of the lid part (which is just as good as that of the support pallet) allows safe stacking on top of each other of a large number of packaging units which, in practice, can weigh approximately 1 tonne with contents. Unlike packaging units having cardboard lid parts, no reinforcement in the form of supporting beams or similar need be provided for attaining such stacking characteristics inside the packaging units. The entire inner space is available to the user.

The gaps between packaging units stacked on top of one another, into which the prongs of a fork-lift truck penetrate for putting into or taking out of storage or transportation, are limited from above and below by rigid material, specifically in each case by a pallet. By this means, by contrast with packaging units which consist of a pallet and a carton placed on top of it, there is a reduction in the danger of damage to the packaging which exists when the fork-lift truck prongs are not put exactly vertically into the pallet underside, or pressure is exerted on the upper side of the packaging unit underneath the packaging unit that is to be moved when there is tilting of the fork guide. Such damaged packaging units give the user an unfavourable picture of the manufacturer and also lead to anxiety about uninsurable transport damage.

Due to the mechanically firm closing off of the packaging unit and the consequent greatly reduced risk of damage, even if only visually disadvantageous, to the marginal wall arrangement which is in practice often made out of corrugated cardboard the marginal wall arrangement can also be used more frequently. Marginal wall arrangements which are visually no longer impeccable are by contrast to a great extent unacceptable with regard to a company's image.

The packaging unit according to the invention consists of elements which in practice (pressboard pallets and corrugated cardboard marginal wall arrangement) with standard European pallet dimensions and a height of about 1 m weigh according to size only around 5 to 10 kg and are thus easily moved by hand without any supplementary means.

The pallets and the marginal wall arrangement are in each case economical parts. In case of any damage they may further be recycled without any problem or disposed of as waste.

Although in the implementation examples described above the pallets are moulded parts from pressboard material (chipped wood scrap bound by urea condensation resin) it goes without saying that the advantages described regarding the stacking of the packaging units and the pallets are obtained in equal measure if the pallets are made out of another robust material e.g. steel or aluminium sheet.

Instead of single or multiple layered corrugated cardboard for the marginal wall arrangement, honeycombed cardboard material or metal-wood or plastic-honeycombed material. The only important thing is that the marginal wall exhibits adequate resistance to buckling and weather.

Although the present invention has been described and illustrated in detail, it should be clearly understood that the same is by way of illustration and example only and is not to be taken by way of limitation, the spirit and scope of the present invention being limited only by the terms of the appended claims.

I claim:

1. A stackable packaging unit with a lower pallet, a marginal wall arrangement having an upper end and a lower end borne by the lower pallet and a cover part borne by the marginal wall arrangement, the lower pallet being a stackable moulded part which has downwards projecting feet and foot receptors formed in an upper side of the lower pallet, into which, when another lower pallet is superimposed on said lower pallet, the feet of said other lower pallet may be introduced, wherein the cover part is formed by an upper pallet, which has the same shape as the lower pallet, the lower pallet and the upper pallet thus being items of a stock of identical standard pallets, and which is placed on top of the marginal wall arrangement in such orientation that the feet of the upper pallet hang downwards; and wherein the feet of the upper and lower pallets and/or the foot receptors of the upper and lower pallets are formed asymmetrically with respect to a plane of symmetry of the upper and lower pallets, respectively, or with respect to a central axis of the upper and lower pallets being perpendicular to the plane of the upper and lower pallets such that in two different relative positions of two superimposed standard pallets the feet of the overlying one of these two superimposed standard pallets engage into the foot receptors of the underlying one of said two superimposed standard pallets by two different distances (Z1, Z2).

2. Packaging unit according to claim 1, wherein upper and lower sides of the standard pallets are formed with means for aligning, positioning and fixing of the upper and the lower ends of the marginal wall arrangement, respectively.

3. Packaging unit according to claim 1, wherein the feet and the foot receptors of the standard pallets are arranged at locations which are symmetric to central planes of the standard pallets and wherein the feet and the foot receptors of the standard pallets have ledges, the ledges of pairs of feet and the ledges of pairs of foot receptors which are arranged at two symmetric ones of said locations being arranged at different distances (X) from the central plane of the standard pallets.

4. Packaging unit according to claim 1, wherein the foot receptors of the standard pallets are angularly offset with respect to said central axis of the standard pallets and are of different lengths.

5. Packaging unit according to claim 3, wherein at least one edge of the standard pallets is provided with a marking.

6. Packaging unit according to claim 1, wherein the upper sides of the feet provide the foot receptors.

7. Packaging unit according to claim 6, wherein the feet and with them also the foot receptors have roughly the shape of a hipped roof having an inner main surface and an outer main surface as well as end surfaces and wherein the inner main surfaces of the feet each are formed with a ledge.

8. Packaging unit according to claim 1, wherein the standard pallets are moulded parts from pressboard material.

9. A stackable packaging unit, comprising:

a lower located standard pallet;

a marginal wall structure having an upper end and a lower end supported at an upper surface of the lower located standard pallet; and an upper located standard pallet supported by an upper edge of the marginal wall structure, wherein the lower located standard pallet and the upper located standard pallet are identical and each has the form of a stackable moulded part provided with a plurality of downwardly depending feet and a plurality of foot receptors formed in an upper surface into which the respective feet of another standard pallet may be located, wherein the upper located standard pallet is placed on top of the marginal wall with its feet depending downward into a space defined by the marginal wall, wherein one or both of the feet and the foot receptors of each of said standard pallets are formed to be disposed asymmetrically either with respect to a plane of symmetry of the standard pallet or with respect to a central axis perpendicular to a plane of the standard pallet, whereby in respective first and second arrangements an overlying standard pallet may be supported by an underlying standard pallet with the feet of the overlying standard pallet fitted into corresponding receptors of the underlying standard pallet to provide respective first and second separation distances Z1 and Z2 between the overlying and underlying standard pallets.

10. The packaging unit according to claim 9, wherein:

the upper and lower sides, respectively, of each standard pallet are formed to include means for aligning, positioning, and fixing of a lower and an upper end, respectively, of corresponding marginal wall structures.

11. The packaging unit according to claim 9, wherein:

the feet and the foot receptors of each standard pallet are arranged at locations which are symmetrically disposed relative to a central plane of said standard pallet, and wherein the feet and foot receptors are arranged in pairs to have respective ledges arranged at symmetrically paired locations at respectively different distances relative to the central plane.

12. The packaging unit according to claim 9, wherein:

the foot receptors of each standard pallet are angularly offset with respect to a central axis of said standard pallet and are of respective different depths.

13. The packaging unit according to claim 11, wherein:

at least one edge of each standard pallet is provided with a marking.

14. The packaging unit according to claim 9, wherein:

the upper sides of the feet are respectively formed to provide corresponding foot receptors.

15. The packaging unit according to claim 14, wherein:

the feet and the foot receptors each have a shape substantially that of a hipped roof having an inner main surface, an outer main surface and an end surface, and wherein the inner main surfaces of the feet are each formed to have a corresponding ledge.

16. The packaging unit according to claim 9, wherein:

the standard pallets are each moulded from pressboard material.

* * * * *